United States Patent [19]

LaSota

[11] Patent Number: 4,850,889

[45] Date of Patent: Jul. 25, 1989

[54] SERIAL ELECTRICAL CONNECTOR

[76] Inventor: Laurence LaSota, 15745 North Park, East Detroit, Mich. 48021

[21] Appl. No.: 202,400

[22] Filed: Jun. 6, 1988

[51] Int. Cl.[4] ..... H01R 13/15; H01R 13/635; H01R 13/637

[52] U.S. Cl. ..... 439/262; 439/197

[58] Field of Search ..... 439/65, 260, 262, 264, 439/197, 259, 203, 265

[56] References Cited

U.S. PATENT DOCUMENTS

| | | | |
|---|---|---|---|
| 1,917,009 | 7/1933 | Betts et al. | 439/262 |
| 2,636,068 | 4/1953 | Perkins | 439/197 |
| 2,945,201 | 7/1960 | Waninger | 439/262 |
| 2,978,666 | 4/1961 | McGregor | 439/197 |
| 3,090,026 | 5/1963 | Raddin | 439/197 |
| 3,489,986 | 1/1970 | Frederick | 439/264 |
| 3,541,490 | 11/1970 | Berg | 439/264 |
| 3,648,221 | 3/1972 | Tillmann et al. | 439/264 |
| 3,750,086 | 7/1973 | Iversen | 439/264 |
| 3,941,446 | 3/1976 | Cantwell | 439/262 |
| 4,054,347 | 10/1977 | Mouissie | 439/264 |
| 4,220,389 | 9/1980 | Schell | 439/197 |
| 4,272,143 | 6/1981 | Weiss | 439/266 |
| 4,420,205 | 12/1983 | Kirkman | 439/266 |
| 4,468,072 | 8/1984 | Sadigh-Behzadi | 439/266 |

OTHER PUBLICATIONS

FR-1982-06.

IBM Technical Disclosure Bulletin-vol. 9, No. 10, Mar. 1967.

IBM Technical Disclosure Bulletin-vol. 13, No. 11, Apr. 1971.

IBM Technical Disclosure Bulletin-vol. 12, No. 11, Apr. 1970.

*Primary Examiner*—Eugene F. Desmond

*Attorney, Agent, or Firm*—Basile and Hanlon

[57] ABSTRACT

An electrical connector includes a plurality of spaced electrical contacts serially arranged in the electrical connector body and adapted to receive mating electrical contacts mounted in a mating electrical connector member. Insulator members are mounted in the electrical connector and are movably disposed between the spaced electrical contacts. A pressure applying device acts on the serial arrangement of electrical contacts and movable insulator members to secure mating electrical contacts together in a fixed electrical connection and to provide a low insertion and removal force when pressure is released therefrom. In one embodiment, a biased wedge member is mounted in the electrical connector and normally applies pressure to the serial arrangement of movable insulator members and mating electrical contacts. Alternately, an expansible, fluid filled chamber is mounted on the electrical connector and includes an expansible diaphragm which expands when the internal volume of the chamber is increased to apply pressure to the stacked arrangement of movable insulator members and mating electrical contacts.

9 Claims, 2 Drawing Sheets

SERIAL ELECTRICAL CONNECTOR

BACKGROUND OF THE INVENTION

1. Field of the Invention

The present invention relates to electrical connectors for joining two electrical components or conductors together.

2. Description of the Prior Art:

Electrical connectors are widely used to connect two discrete, separate circuits or electrical devices together in electrical contact to complete an electric circuit therebetween. In such connectors, the electrical conductors of one circuit or device terminate in or are joined to contacts which are fixedly mounted in a connector body. Mating contacts attached to the conductors of another circuit or device are likewise mounted in a connector body which is inserted into the mating connector body to join the contacts together in electrical connection.

Biasing devices are commonly employed to urge the mated contacts together in a secure connection. However, the requirement of secure electrical contact between mating electrical contacts is opposed to the requirement of a low insertion and/or removal force when joining or separating the two connector bodies.

Various arrangements have been devised to apply or increase the pressure between the mating contacts of joined connector bodies after the bodies are joined together. Typically, cams or slider members are movable after the connector bodies are joined together to activate springs or other biasing means to urge the contacts together and hold the contacts together in a secure connection. However, such biasing means operate independently or in parallel on each mating contact pair across the plurality of contacts in a typical electrical connector. Thus, due to misalignment of the contacts, wear or manufacturing tolerances, one or more of the contacts in one connector body may be out of proper mating position thereby resulting in a misfit or non mating joinder of the contacts. At the same time, such tolerance or misalignment causes varying contact pressure between mating contact pairs in the connector which may result in a unstable or non connection between certain contacts pairs. In a multi-contact connector, the misalignment of only one contact could prevent the operation of an entire circuit. Further, such misalignment of inoperability of one contact pair is difficult and time consuming to locate and repair.

Thus, it would be desirable to provide an electrical connector which provides a secure electrical contact between all mating contacts in a two-part, separable electrical connector. It would also be desirable to provide an electrical connector which provides high pressure contact between mating contacts along with a zero or minimal insertion or removal force when joining or separating the contact carrying connector bodies. It would also be desirable to provide an electrical connector having these features which may be constructed in any form or shape and with any number of electrical contacts. Finally, it would be desirable to provide an electrical connector which provides the same connecting force on all mating contact pairs in the connector.

SUMMARY OF THE INVENTION

The present invention is an electrical connector for electrically connecting contacts attached to the conductors of two separate electrical circuits or devices. The electrical connector has a plurality of electrical contacts fixedly mounted therein which are matable with the contacts in another connector member. A plurality of movable, insulator members are carried by the electrical connector and are disposed adjacent to the contact surfaces of the electrical contacts and are movable with respect to the electrical contacts.

Means are provided for serially applying pressure to the movable insulator members and the mating contacts when the electrical connector is joined to another connector member to urge the movable members and the mated electrical contacts together under high pressure to thereby fixedly hold the mated contacts together in a secure electrical connection. In one embodiment, the pressure applying means includes a cavity formed in the electrical connector having an inclined surface facing the serially arranged stack of movable insulator members. A wedge member is movably disposed in the cavity and has an inclined face disposed in sliding contact with the inclined surface in the cavity of the electrical connector member and a planar surface disposed in contact with the endmost movable member. Actuating means are disposed within the cavity for biasing the wedge member outward from the cavity to normally urge the wedge member under pressure into contact with the movable members and the mating contacts thereby joining the contacts together in a pressured connection.

Alternately, the pressure applying means may be in the form of a fluid filled, expansible chamber mounted on one end of the electrical connector member. A flexible, expansible diaphragm is mounted on one wall or portion of the chamber. Plunger means is slidably disposed in the chamber and varies the volume of the chamber to cause expansion of the flexible diaphragm and a force to be applied to the movable members disposed in registry with the expansible diaphragm. Releasable lock means may be employed with the plunger means to hold the plunger means in an extended position to retain the mated contacts and movable members together in a secure, pressured electrical connection.

The electrical connector may be provided in any form, such as an elongated body with serially arranged parallel contacts or in a circular arrangement depending upon the connector application. In a circular shaped connector, the pressure applying wedge member is interposed between two adjacent movable members and has opposed inclined surfaces which act upon and urge the movable members circumfrentially under pressure toward the other movable members and interposed mated electrical contacts in the joined connector bodies.

The serial electrical connector of the present invention uniquely provides a secure electrical connection between mated electrical contacts which prevents disengagement of the contacts and insures a high pressure contact between all mated contacts regardless if any contacts are misaligned or out of position. Further, the serial electrical connector of the present invention provides the secure electrical contact connection with the advantages of low or zero insertion and removal force. This prevents damage to the contacts and makes it easy to join or separate the contact carrying connector members.

Due to the movable and series arrangement of the insulator members and interposed mated contacts, the serial electrical connector of the present invention is self adjusting to accommodate misalignment of any of the contacts in the connector members. Further, the serial application of pressure to the stacked or serial arrangement of the movable members and interposed mated contacts insures an equal and even distribution of pressure to each mated contact pair. Finally, the use of high pressure, which may be varied depending upon the connector application to higher or lower levels, provides a secure electrical connection which minimizes corrosion or oxidation of the contacts thereby increasing the reliability and useful life of the serial electrical connector of the present invention.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
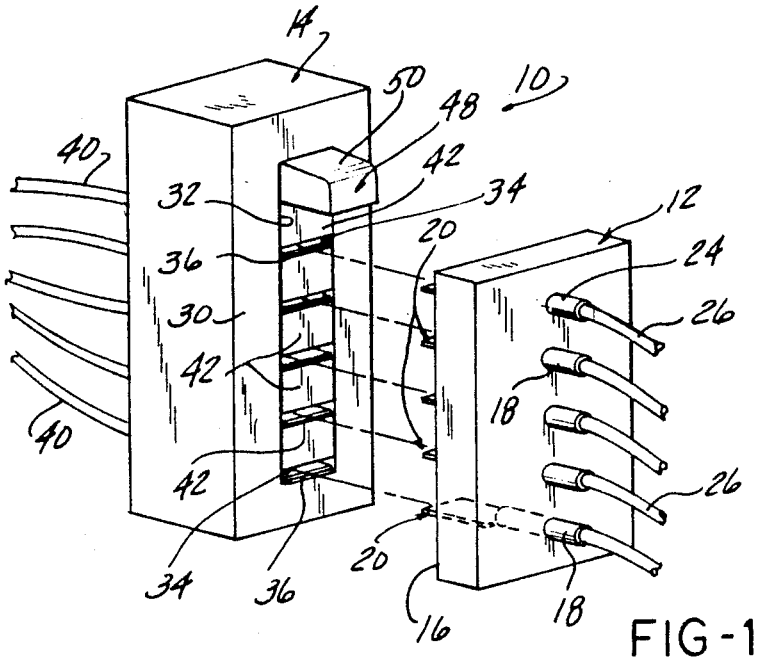
FIG. 1 is a perspective, exploded view of one embodiment of the serial electrical connector of the present invention.

Throughout the following description and drawing, an identical reference number is used to refer to the same component shown in multiple figures of the drawing.

Referring now to the drawing and to FIG. 1 in particular, there is illustrated a serial electrical connector 10 which provides secure electrical connection between electric contacts mounted in joinable connector members or bodies. The electrical connector 10 is suited for any use in making electrical connections between electrical circuits and electrically operated devices. Thus, the electrical connector 10 may be mounted as a stationary wall outlet or as merely a connector between two separate electrical conductors.

Figure 2:
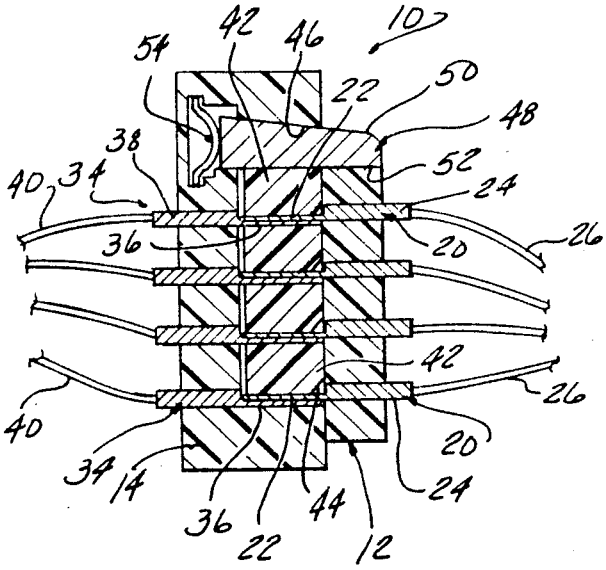
FIG. 2 is a side, cross sectional view of the electrical connector shown in FIG. 1, illustrated in a connected position.
Figure 3:
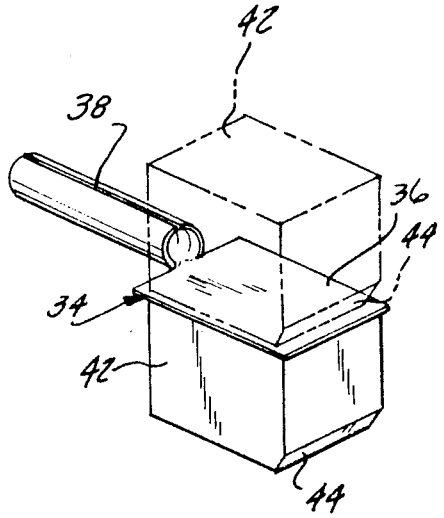
FIG. 3 is an enlarged, perspective view of a typical electrical contact and associated insulator members employed in the electrical connector shown in FIGS. 1 and 2.

As shown in FIGS. 1, 2 and 3, a first, conventionally constructed electrical connector member 12 is separably joinable to a second electrical connector 14 constructed in accordance with the teachings of the present invention. The first and second electrical connector members 12 and 14 may have any shape, such as the elongated planar shape shown in FIGS. 1 and 2. The first and second electrical connectors 12 and 14 are also formed of any suitable, rigid material, preferably, and electically insulating plastic material, such as PVC.

The first electrical connector member 12 is conventionally formed of a body having a front face 16 which is connectible to the second electrical connector member 14. A plurality of bores 18 are formed in the body of the first electrical connector member 12 in a spaced apart manner. The number of bores 18 is selected to coincide with a number of electrical contacts 20 to be mounted in the first electrical connector member 12.

As shown in FIG. 2, each electrical contact 20 has a planar portion 22 forming an electrical contact surface and a hollow, tubular sleeve 24 integrally joined therewith. The sleeve 24 is adapted to receive one end of an electrical conductor 26 which is secured thereto by crimping, soldering, etc. The planar portion 22 of each contact 20 extends through the body 16 and outward from the face 16 as shown in FIGS. 1 and 2.

Each of the contacts 20 is formed of an electrically conductive material, such as copper, and the number of contacts 20 may be varied as necessary depending upon the application of the electrical connector 10 and the number of conductors 26 which are to be electrically connected to other conductors. The contacts 20 are mounted in the bores 18 by forming the bores 18 separately and inserting the contacts 20 therethrough or by molding the first electrical connector body 12 about the spaced contacts 20. As shown in FIGS. 1 and 2, the planar portions 22 of each of the contacts 20 are spaced apart along the length of the first electrical connector member 12.

The second electrical connector 14 also has an elongated, substantially planar body with a square or rectangular cross section. The second electrical connector member 14 is likewise formed of an electrically insulating plastic material.

The front face 30 of the second electrical connector member 14 is planar in form to conform to the face 16 of the first electrical connector member 12 when the first and second electrical connector members 12 and 14 are joined together or placed in registry.

A recess 32 is formed in the second electrical connector member 14 and extends inward from the face 30. A plurality of electrical contacts 34, as shown in FIGS. 1, 2 and 3, are identically constructed as the contacts 20, and are fixedly mounted in a spaced apart manner in the second electrical connector member 14. The planar portions 36 of the electrical contacts 34 are disposed in the recess 32 and have the same form as the planar portions 22 of the contacts 20 mounted in the first electrical connector member 12 so as to be mated therewith in electrical contact when the first and second electrical connector members 12 and 14 are joined together.

As shown in greater detail in FIG. 2, the tubular sleeve portions 38 of the contacts 34 extend through the body of the second electrical connector member 14 and outward therefrom. Each tubular sleeve 38 receives one end of an electrical conductor 40 which is secured thereto by crimping, soldering, etc. Preferably, the body of the second electrical connector member 14 is molded to its illustrated shape about the contacts 34 to fixedly mount the contacts 34 at the same spacing as the spacing between the contacts 20 in the first electrical connector member 12.

As shown in FIGS. 1, 2 and 3, a plurality of movable insulator members 42 are mounted in the recess 32 in the second electrical connector member 14. The movable insulator members 42 have a generally square, cubical shape and are formed of an electrically insulating material, such as plastic. Further, the overall size of each movable insulator member 42 is selected such that each insulator member 42 can be disposed between two spaced electrical contacts 34 with a small amount of movement relative to the fixed contacts 34 to create an opening for receiving one of the contacts 20 in the first electrical connector member 12 in mating connection with the contact 34.

Each of the movable insulator members 42 has an inclined or tapered front edge 44 facing the edge of the planar portion 36 of the adjacent contact 34 to provide ease of insertion of the mating contacts 20 in the first electrical connector member 12 into electrical connection with the contacts 34 in the second electrical connector member 14.

As noted above, each of the movable insulator members 42 is movably disposed between adjacent electrical contacts 34. Such movement may be provided by loosely pinning each insulator member 42 in the recess 32 in the second electrical connector member 14 or by extending the edges of the recess 32 inward a small amount to trap the movable members 42 in the recess 32. Alternately, an attachable cover plate may be mounted over the outside surface 30 of the second electrical connector member 14 to trap the movable members 42 therein and yet provide openings for the insertion of the contacts 20 therethrough into mating engagement with the contacts 34 in the second electrical connector member 14.

The electrical connector 10 of the present invention also includes means for applying pressure to the serial or stack arrangement of interposed movable members 42 and mating electrical contacts 20 and 34 when the first electrical connector member 12 is joined to the second electrical connector member 14 as shown in FIG. 2. In one embodiment, the means for applying pressure comprises forming one edge of the recess 32 with an inclined surface 46 as shown in FIG. 2. The inclined surface 46 may be at any predetermined angle and faces the endmost insulator member 42 in the recess 32. A wedge member 48 is movably disposed in the recess 32 adjacent to the inclined face 46 of the cavity recess 32. The wedge member 48 has an inclined face 50 and an opposed planar face 52. The inclined face 50 is at any predetermined angle and slidingly engages the inclined surface 46 at the end of the recess 32. The opposed planar face 52 of the wedge member 48 is disposed in sliding contact with the endmost insulator member 42. The angle of the inclined surface 46 in the second electrical connector member 14 and the inclined face 50 of the wedge member 48 may be provided in any angular degree to provide a pressure ratio of any amount, such as 3:1, 4:1, etc.

The means for applying pressure includes means for actuating the pressure applying means. In one embodiment, the actuating means includes biasing means 54 in the form of a leaf spring mounted within the recess 32 in the second electrical connector member 14 which acts upon one end of the wedge member 48 to normally urge the wedge member 48 outward from the interior of the recess 32 in the second electrical connector member 14. In so doing, the wedge member 48 acts upon the stacked arrangement of interposed movable insulator members 42 and mating contacts 20 and 34 to apply pressure to the stack and secure the mating contacts 20 and 34 together in electrical connection. Pressure is released from the contacts 34 and the movable insulator members 42 to allow insertion of the first electrical connector member 12 into the second electrical connector member 14 or to release the connector members 12 and 14 from each other by manually pushing the exterior end of the wedge member 48 inward against the bias of the spring 54. Release of the wedge member 48 allows it to move outward under the bias of the spring 54 to the position shown in FIG. 2 in which pressure is applied to and the movable insulator members 42 move into forced abutment with the electrical contacts 34 in the second electrical connector member 14 and the mating contacts 20.

Although not shown, other wedge operating mechanisms may also be employed to apply pressure to the stacked arrangement of moveable insulator members 42 and mating contacts 20 and 34. Such wedge mechanisms may include an adjustable rod and a second wedge acting upon the first wedge 48 which varies the angle of the first wedge 48 to apply varying amounts of pressure to the movable insulator members 42 and mated electrical contact stack.

Figure 4:
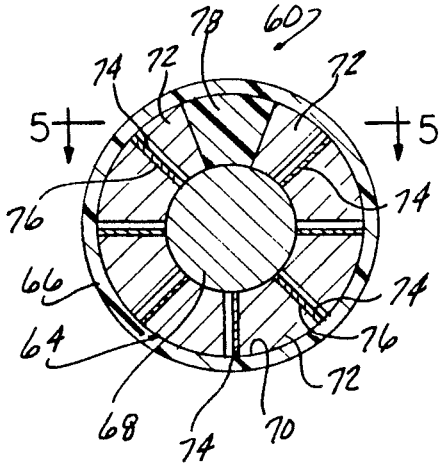
FIG. 4 is a cross sectioned, elevational view of another embodiment of the electrical connector of the present invention.
Figure 5:
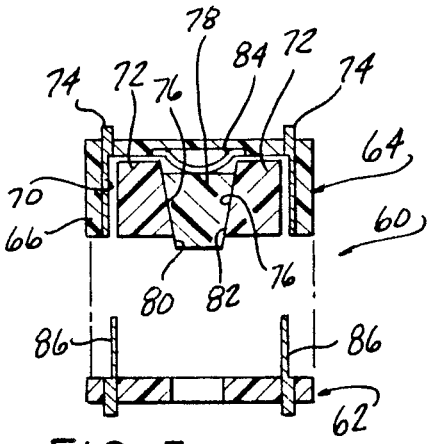
FIG. 5 is a cross sectional view generally taken along line 5—5 in FIG. 4.

As shown in FIGS. 4 and 5, an alternate configuration of the electrical connector 60 is illustrated. In this embodiment, the electrical connector 60 has a circular cross section in which the first and second electrical connector members 62 and 64 each have circular cross sections.

The second electrical connector member 64 is formed with an outer rim section 66 and a centrally located, radially spaced body or hub 68. An open ended recess 70 is formed between the rim 66 and the central hub 68.

A plurality of movable insulator bodies 72 are disposed within the recess 70 between spaced, fixedly mounted contacts 74. The contacts 74 are constructed identically to the contacts 20 and 34 described above and shown in FIGS. 1, 2 and 3.

Each movable insulator member 72 has an inclined or angled side surface 76 which is engageable with an electrical contact 74.

As shown in FIG. 5, the pressure applying means comprises a movable wedge member 78 which is interposed in the recess 70 between two adjacent movable insulator members 72. The wedge member 78 has opposed, angled side surfaces 80 and 82 which slidingly mate with the inclined surfaces 76 of the adjacent insulator members 72. A biasing means in the form of a leaf spring 84 is mounted on the back wall of the recess 70 in the second electrical connector member 64 and normally biases the wedge member 78 outward to apply pressure in a circumfrential direction to the serial arrangement of movable insulator members 72 and interposed contacts 74. Manually urging the wedge member 78 inward against the bias of the spring 84 releases pressure from the insulator members 72 and allows insertion of mating contacts 86 fixedly mounted in a circumfrentially spaced manner in the first electrical connector member 62 into engagement with the contacts 74 in the second electrical connector member 64. Release of the wedge member 78 applies pressure to the movable members 72 and interposed mating contacts 74 and 86 as the wedge member 78 moves outward from the recess 70 to provide secure electrical contact therebetween in the same manner as described above.

Figure 6:
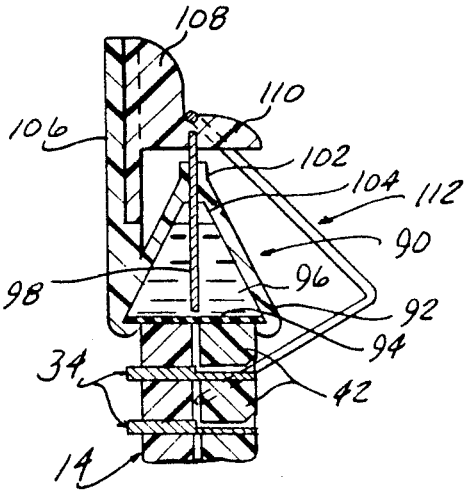
FIG. 6 is a partial, enlarged, sectional view showing an alternate embodiment of the pressure applying means employed in the electrical connector shown in FIG. 1.
Figure 7:
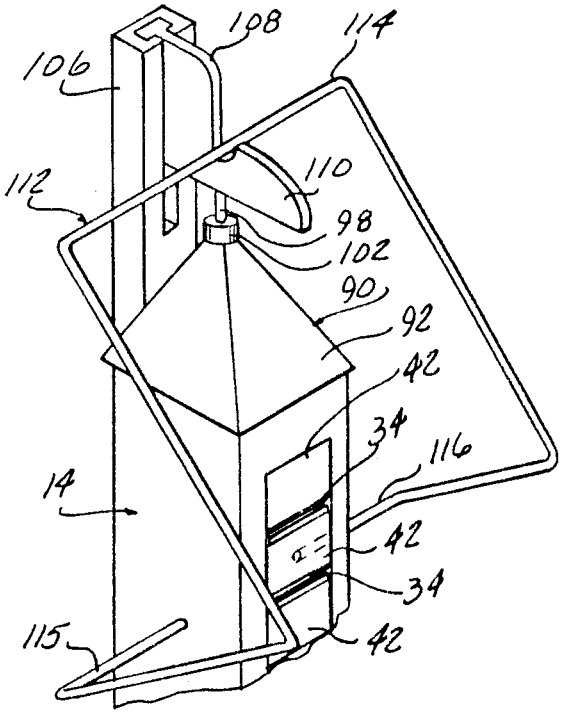
FIG. 7 is a partial, perspective view of the alternate pressure applying means shown in FIG. 6.

FIGS. 6 and 7 illustrate another embodiment of the means for applying pressure to the stacked arrangement of movable insulator members 42 and mating contacts 34 and 20 of the embodiment of the electrical connector 10 shown in FIGS. 1 and 2. In this embodiment, an expansible, fluid filled chamber 90 is mounted on one end of the second electrical connector member 14. The chamber 90 comprises a solid body 92 having a flexible, movable diaphragm 94 mounted adjacent to and forming one end of the body 92 of the chamber 90. The diaphragm 94 sealingly closes the interior of the chamber 90 and is disposed in registry with the endmost insulator member 42. A non-compressible fluid 96, such as water, oil, etc., fills the interior of the chamber 90.

Actuator means in the form of an elongated, slidable plunger 98 is slidably disposed through the top end 102 of the body 92 of the chamber 90. A seal 104 seals the end 102 of the chamber 90. The plunger 98 varies the volume of the chamber 90 depending on the amount it is disposed within the chamber 90 such that when it is slid into the interior of the chamber 90, the volume of the chamber 90 increases and the diaphragm 98 expands outward applying pressure to the stacked arrangement of insulator members 42 and interposed, mating contacts 20 and 34 of the joined first and second electrical connector members 12 and 14. Retraction of the plunger 98 from the chamber 90 decreases the volume of the chamber 90 and releases pressure from the insulator members 42 and contacts 20 and 34.

Releasable lock means is provided for releasably holding the plunger 98 in its internally disposed position within the chamber 90. The lock means comprises a post member 106 formed with or joined to the body 92 of the chamber 90 and extending upward therefrom. The post 106 forms a guide for a slider member 108 which is mounted in a suitable slide arrangement thereon as shown in FIG. 7. The slider 108 has an outwardly extending flange portion 110 to which one end of the plunger 98 is fixedly secured. As shown in FIGS. 6 and 7, movement of the slider 108 along the post 106 causes extension or retraction of the plunger 98 into and out of the interior of the chamber 90. The lock means also includes a spring clip 112 for holding the slider 108 in a down position in the orientation shown in FIGS. 6 and 7 to apply pressure through the expanded diaphragm 94 to the movable insulator members 42 and interposed contacts 20 and 34. The spring clip 112 has an elongated, planar central portion 114 which is releasably engageable with the flange 110 of the slider 108. The outermost ends 115 and 116 of the clip 112 are pivotally secured to the sides of the second electrical connector member 14 to provide pivoting action of the spring clip 112.

While the serial electrical connector of the present invention has been described and illustrated as being formed of two separably joinable electrical connector members, it will be understood that the present invention extends to an electrical connector formed of only a single connector member, such as the second electrical connector members 14 and 64, as the construction, shape and function of the described first connector members 12 and 62 is well known and the second connector members 14 and 64 may be formed to mate with any known connector having contacts extending outward therefrom.

In summary, there has been disclosed a unique serial electrical connector which provides a secure, high pressure connection between mating contacts fixedly mounted in separate connector bodies and, at the same time, provides zero or minimal insertion and removal force to engage or disengage the connector bodies from each other. The use of movable insulator bodies between the spaced contacts in one of the connector members enables pressure to be applied to the mated contacts in a serial fashion evenly across the entire connector thereby preventing the application of differing amounts of pressure and the resulting varying amounts of contact resistance to selected mating contact pairs which could result in a defective connection. The electrical connector of the present invention is easily constructed in different configurations for widespread use in many diverse applications and provides the advantages listed above in each configuration.

What is claimed is:

1. An electrical connector separably joinable to an electrical connector member having a plurality of spaced electrical contacts mounted therein, with a portion of the contacts extending outward therefrom, the electrical connector comprising:

a body having a plurality of spaced electrical contacts fixedly mounted therein, each contact being separably matable to an electrical contact in the electrical connector member;

a plurality of movable insulator members separably and co-axially mounted in the body, one insulator member being disposed adjacent to and movable with respect to each electrical contact in the electrical connector; and means for serially applying pressure to the endmost one of the co-axially arranged movable insulator members to serially urge all of the movable insulator members together in secure engagement with mated pairs of the electrical contacts in the electrical connector member and the electrical contacts in the electrical connector after the electrical connector member is joined to the electrical connector, the means for applying pressure comprising:

a cavity formed in the body of the electrical connector, the cavity having an inclined surface facing an endmost insulator member;

a movable wedge member disposed in the cavity, the wedge member having an inclined surface disposed in sliding contact with the inclined surface in the cavity of the electrical connector and a planar surface disposed in contact with the endmost movable insulator member; and actuating means, disposed within the cavity in the body of the electrical connector member, for activating the wedge member to apply pressure to the endmost movable insulator member.

2. The electrical connector of claim 1 wherein the actuating means comprises:

a spring mounted in the cavity in the body of the electrical connector and acting on the wedge member to normally urge the wedge member outward from the cavity.

3. The electrical connector of claim 1 wherein:

a recess is formed in the body of the electrical connector;

the plurality of electrical contacts are fixedly disposed in a spaced apart manner in the recess in the body of electrical connector;

the plurality of movable insulator members are disposed within the recess and interposed between the electrical contacts; and the plurality of electrical contacts and the plurality of movable insulator members being serially arranged in the recess in the electrical connector with respect to the pressure applying means.

4. The electrical connector of claim 3 wherein the electrical connector has an elongated, planar form.

5. An electrical connector separably joinable to an electrical connector member having a plurality of spaced electrical contacts mounted therein, with a portion of the contacts extending outward therefrom, the electrical connector comprising:

a body having a recess, a circular cross section, and a plurality of spaced electrical contacts fixedly and circumferentially spacedly mounted in the recess, each contact being separably matable to an electrical contact in the electrical connector member;

a plurality of movable insulator members separably and circumferentially spacedly mounted in the recess in the body, one insulator member being disposed adjacent to and movable with respect to each electrical contact in the electrical connector; and means for serially applying pressure to the certain of the movable insulator members to serially urge all of the movable insulator members together in secure engagement with mated pairs of the electrical contacts in the electrical connector member and the electrical contacts in the electrical connector after the electrical connector member is joined to the electrical connector, the pressure applying means including a wedge member serially disposed between two adjacent movable insulator members in the body of the electrical connector, the wedge member having opposed inclined surfaces acting upon the adjacent movable insulator members; and further including:

actuating means mounted in the electrical connector for actuating the wedge member to a pressure applying position with respect to the adjacent movable insulator members.

6. An electrical connector separably joinable to an electrical connector member having a plurality of spaced electrical contacts mounted therein, with a portion of the contacts extending outward therefrom, the electrical connector comprising:

a body having a plurality of spaced electrical contacts fixedly mounted therein, each separably matable to an electrical contact in the electrical connector member;

a plurality of movable insulator members mounted in the body, one insulator member being disposed adjacent to and movable with respect to one electrical contact in the electrical connector; and means for serially applying pressure to the movable insulator members to urge the movable insulator members together in secure engagement with mated pairs of the electrical contacts in the electrical connector member and the electrical contacts in the electrical connector when the electrical connector member is joined to the electrical connector, the pressure applying means comprising:

a fluid filled chamber mounted on the body of the electrical connector;

a flexible, expandible member mounted on the chamber and disposed in contact with one of the movable insulator members; and plunger means extensibly mounted on the chamber and slidingly insertable into the interior of the chamber for varying the volume of the chamber and causing expansion of the flexible member against the one movable insulator member to apply pressure thereto.

7. The electrical connector of claim 6 further including:

means for releasably locking the plunger means in a position corresponding to the expanded position of the expandible member.

8. The electrical connector of claim 7 wherein the locking means comprises:

a slider member mounted on the body of the electrical connector and carrying the plunger means affixed thereto; and clip means, pivotally mounted on the body of the electrical connector and releasably engageable with the slider members for holding the slider member in the fixed, locked position.

9. An electrical connector comprising:

a first electrical connector member having a plurality of spaced electrical contacts fixedly mounted therein with a portion extending outward therefrom;

a second electrical connector member having a plurality of spaced electrical contacts fixedly mounted therein and adapted to mate with the contacts of the first electrical connector member;

a plurality of movable, separate, insulator members co-axially mounted in the second electrical connector member and interposed between the spaced electrical contacts in the second electrical connector member, each movable insulator member defining an opening adjacent each electrical contact in the second electrical connector member for receiving an electrical contact of the first electrical connector member in mating electrical engagement with the contact of the second electrical connector member, the electrical contacts of the first and second electrical connector members, when joined together, and the interposed movable insulator members being disposed in a serial arrangement; and means, mounted on the second electrical connector member, for releasably applying pressure to one end of the serial arrangement of movable insulator members and the contacts of joined first and second electrical connector members, the means for applying pressure comprising:

a cavity formed in the body of the electrical connector, the cavity having an inclined surface facing an endmost insulator member:

a movable wedge member disposed in the cavity, the wedge member having an inclined surface disposed in sliding contact with the inclined surface in the cavity of the electrical connector and a planar surface disposed in contact with the endmost movable insulator member; and actuating means, disposed within the cavity in the body of the electrical connector member, for activating the wedge member to apply pressure to the endmost movable insulator member.

* * * * *